US005469723A

United States Patent [19]

Litwin et al.

[11] Patent Number: 5,469,723

[45] Date of Patent: Nov. 28, 1995

[54] SAFETY LOCKS

[76] Inventors: Noel Litwin; Abraham I. Scherz, both of Leiva 4875, Buenos Aires, Argentina

[21] Appl. No.: 982,691

[22] Filed: Nov. 25, 1992

Related U.S. Application Data

[63] Continuation-in-part of Ser. No. 732,216, Jul. 19, 1991, abandoned.

[30] Foreign Application Priority Data

Jul. 25, 1990 [AR] Argentina ..... 317458

[51] Int. Cl.[6] ..... E05B 63/08; E05B 55/02

[52] U.S. Cl. ..... 70/107; 70/143; 70/352; 70/387

[58] Field of Search ..... 70/107, 361, 352, 70/387, DIG. 49, 143; 292/150, 169.13, 254

[56] References Cited

U.S. PATENT DOCUMENTS 1,191,539 7/1916 Schoell ..... 70/107
1,557,374 10/1925 Soley ..... 70/143
4,679,416 7/1987 Kambic ..... 70/143

FOREIGN PATENT DOCUMENTS 728019 4/1955 United Kingdom ..... 70/143

*Primary Examiner*—Peter M. Cuomo
*Assistant Examiner*—Darnell M. Boucher
*Attorney, Agent, or Firm*—Darby & Darby

[57] ABSTRACT

A lock comprising a housing having an indoor side and an outdoor side; an axis passing through the housing from the indoor side to the outdoor side. A main bolt having a bolt portion and a latch portion, the main bolt being displaceable into and out of the housing. A double acting actuating mechanism coupled to the main bolt by the axis, the axis having a first pin to actuate the actuating mechanism and a second pin to actuate the actuating mechanism, the first pin and the second pin displacing the main bolt into and out of the housing. Locking means for preventing displacement of the main bolt. A combination hub being disposed in the housing, the combination hub releasing the locking means when a combination key is introduced into the combination hub. Means for limiting the displacement of the main bolt upon movement out of the housing such that only the latch portion is exposed out of the housing.

17 Claims, 8 Drawing Sheets

6
19'
5''
9
19
19''
43
14
15''
I
15'
15
d
20
6'
21'
e
21
II
6''
25'
25
17
18
44
46
13
45
1
5
7
12''
12
10
16
11
25'
12'
f
4
25
9
4
8
24
9
5''
22
23
9''
II
8
32
22'
30
29'
2
26
27'
56
26'
5''
c
27
29
28

6
19'
5''
9
46
19
19''
43
15''
18
45
44
13
15'
16
12''
d
1
12
20
7
15
5
6'
4
12'
10
6''
25
4'
f
8
22
23
9''
21'
5''
e
8'
21
22'
30
36
25'
2'
26
25
26'
5
30
27
33
28

19
46
44
5''
9
19'
6
6
45
17
18
14
13
12''
1
7
5
12
10
11
15
12'
4
16
20
9'
4
25'
25
6''
e
22
25'
25
23
24
9''
32
30
56
22'
26
2'
26'
c
29
28
27

6
19'
5''
9
19
19''
43
15''
6'
17
18
46
14
44
13
1
15'
5
15
45
7
20
12
12''
4
16
12'
25'
4'
9
g
8
22
24
e
9''
8'
32
21
6''
2
22'
30
56
25'
25
27
26
26'
5''
c
57
29
28

Fig. 6
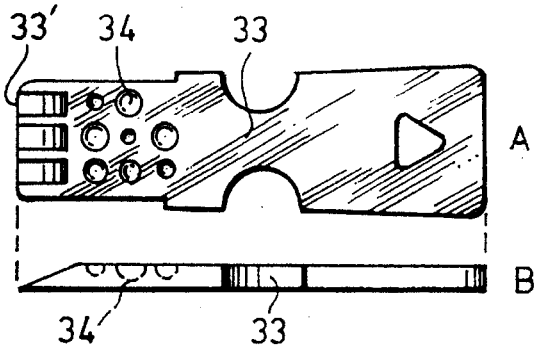
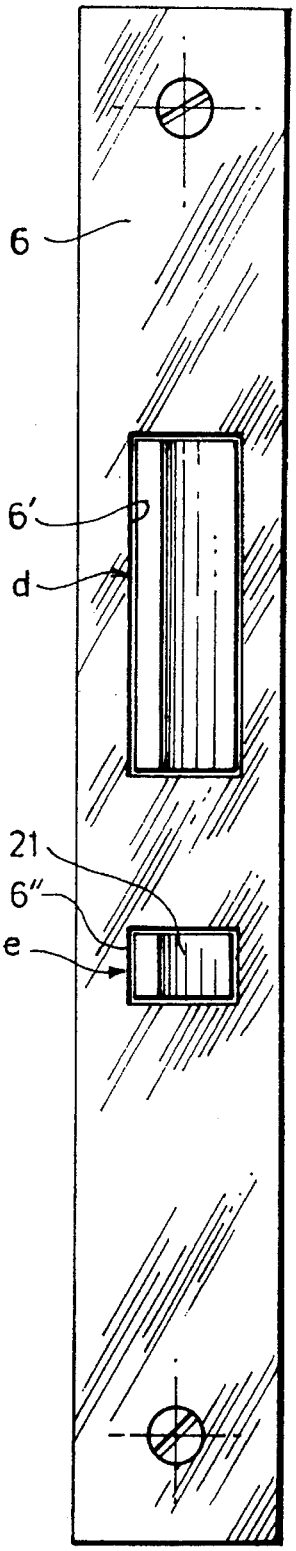
Fig. 7
Fig. 8
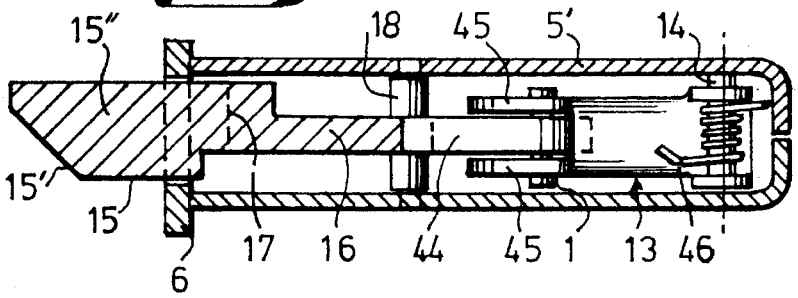

Fig. 9
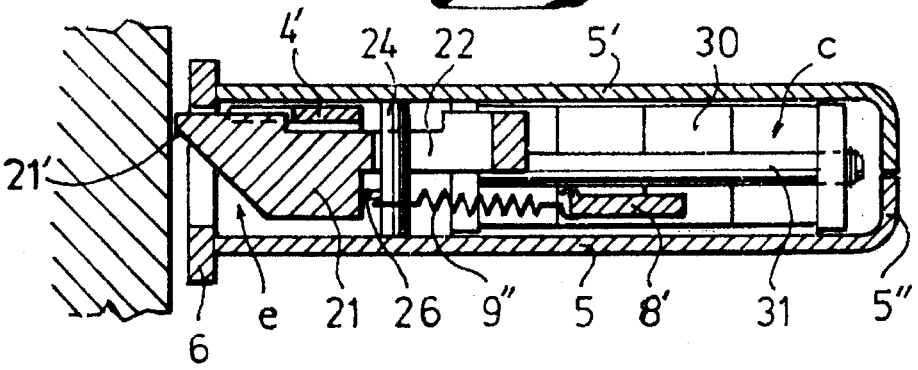
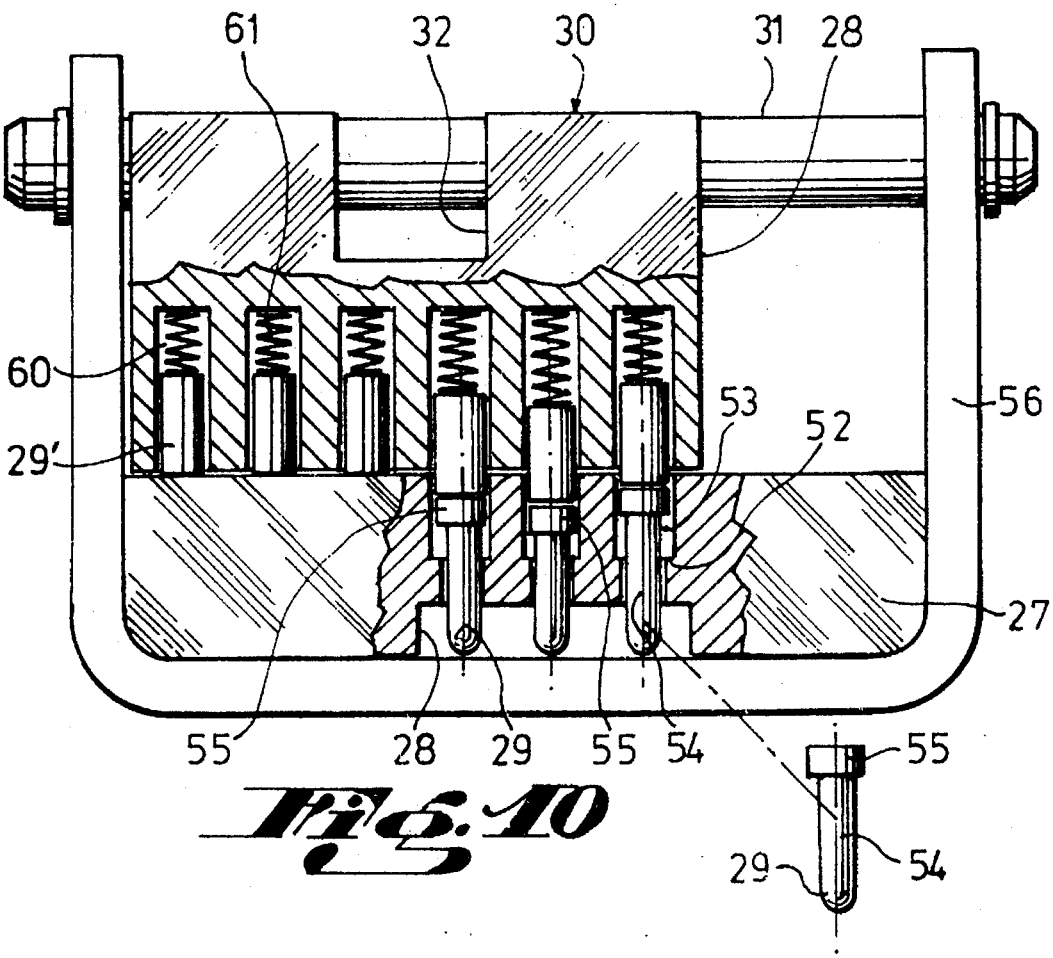
Fig. 10

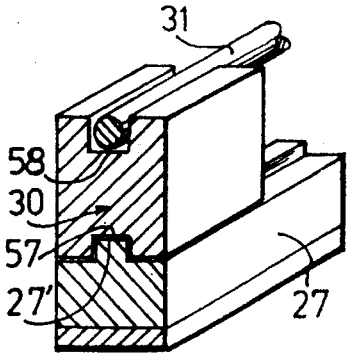
Fig. 11
Fig. 12
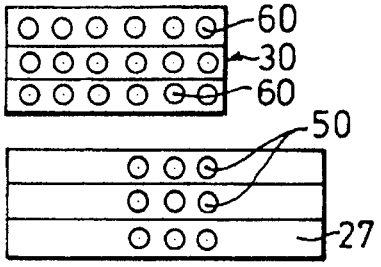
Fig. 13
Fig. 14
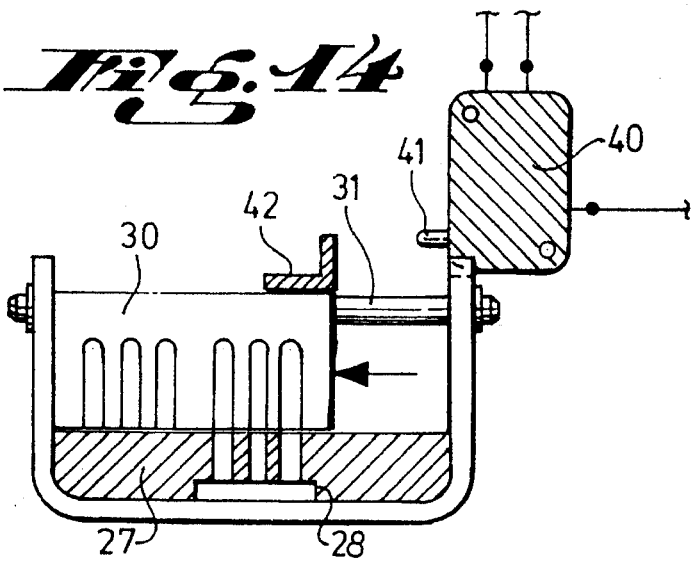
Fig. 15
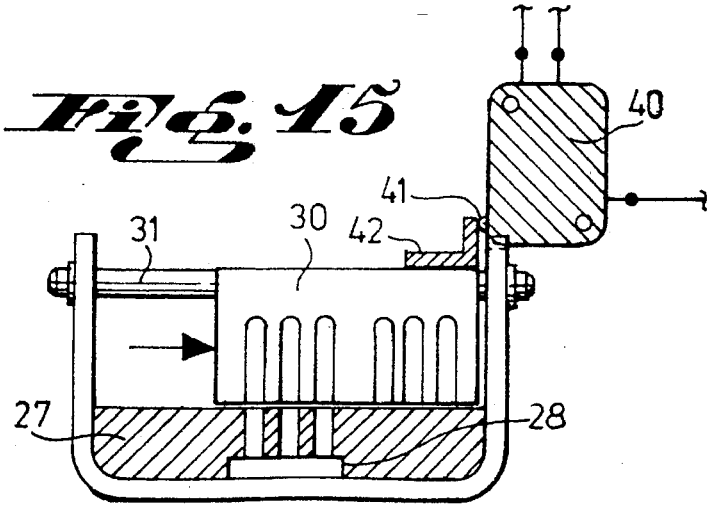

SAFETY LOCKS

This is a continuation-in-part application of U.S. Ser. No. 07/732,216 filed Jul. 19, 1991, now abandoned.

FIELD OF THE INVENTION

The present invention relates to improvements of safety locks which provide for the automatic closing of a locking bolt when in the closed position. More specifically, the present invention relates to a safety lock where it is possible to open the lock from the outdoors only with the key of a combination hub, and from indoors without the need of operating such a combination hub. The combination hub consists of a fixed portion and a movable portion which moves over the fixed portion.

BACKGROUND OF THE INVENTION

The inventor of the present invention has been granted Letters Patent in Argentina under number 175,115 and the equivalent thereof in the United States under U.S. Pat. No. 3,640,107, directed to a key controlled lock having a locking bolt that is controlled by a key having a plurality of grooves of varied predetermined depths. The lock includes a fixed base having a channel defining on one side thereof, a keyway and at least three perforations that are defined non-linearly within the fixed base. The perforations open into the keyway and the channel is defined in the fixed base. A bolt control element is movable with respect to and is operatively connected to the bolt. The bolt control element is movably secured within the channel and has a plurality of bolt pin receiving bores which correspond to the plurality of perforations when the bolt control element is in the locked position. A plurality of bolt pins are slidably secured within the bores and a corresponding plurality of driver pins, having varied predetermined lengths are slidably secured within the perforations such that when the control element is locked, the bolt pins are depressed from the bores into the perforations and the driver pins are biased into contact with the surface of the keyway. When the key is inserted in the keyway, the plurality of grooves, of varied predetermined depths, in the key correspond with each of the driver pins, respectively. The plurality of grooves counterbias each of the driver pins and the bolt pins to cause each juncture between each of the bolt pins and the driver pins to be positioned at the interface of the bolt control element and the channel to allow the bolt control element to be moved in the channel without opposition from the bolt pins or the driver pins and without movement of the key.

The construction disclosed U.S. Pat. No. 3,640,107 allows the key to be withdrawn in three different positions of the portion which is movable with respect to the fixed one. This fact does not provide safety to users, as the key can be withdrawn in three different positions in which the locking mechanism will not be locked, providing a degree of insecurity which is not preferred in these kind of safety locks.

Further, the lock disclosed in U.S. Pat. No. 3,640,107, does not contemplate a mechanism that is provided with a joint bolt and latch, nor does it contemplate the system of an automatic closure of the bolt in the locking position without the need of using a key in the combination hub. Nor does this patent allow for the opening from the indoors by means of the simple operation of a control knob when the bolt is locked and kept in this position by the combination hub, and without using the key to release the combination hub.

On the other hand, in the disclosure U.S. Pat. No. 3,640,107 regarding the opening of the locking bolt, the combination hub actuating key is necessary from both the indoors and the outdoors. Such a difference is important regarding the present invention upon taking into account certain U.S. state provisions which require the use of doors provided with safety locks to be always permitted to be opened freely from indoors, that is, without the need of a key.

SUMMARY OF THE INVENTION

The present invention relates to a lock whose object it is to provide a locking bolt automatic closing mechanism without the need of locking the same with a key and through the operation of a combination hub.

A further object of the present invention is to provide a lock controlled by a combination hub allowing insertion of and withdrawal of such a key in determined positions which assure the correct closure of the lock mechanism, as well as the opening thereof in a single position.

A yet further object of the present invention is to provide a lock having a locking bolt automatic closure, as previously described, with such a lock being capable of being opened from indoors without the need of releasing such locking bolt with a key through the combination hub.

A yet further object of the present invention is to provide a lock having a locking bolt automatic closure, as previously described, which lock, after being opened, may be closed by the operation of a system of latches, that allows for the displacement of the locking bolt to its operating position without the need of a key in the combination hub.

These objects, as well as others that will be readily apparent from the following description, are attained by a lock which comprises:

a) a main bolt which comprises latch elements, b) which latch elements are operatively associated to a double-action actuating mechanism, c) which mechanism is controlled by an axis passing through the lock, d) which axis incorporates two knobs capable of operating such actuating mechanism in order to displace the main bolt in its alternating movement into and from the lock housing, e) there being a single-operation locking members of the actuating mechanism, whose members coincide with the axis portion which is linked to the external knob, f) the locking device interacting with a combination hub which releases the locking members upon the introduction of a combination key, and a main bolt alternating travel stop device that is able to limit the displacement of the main bolt when the main bolt is displaced from the inside of the lock housing, so that the latch members will remain exposed.

The lock according to the present invention includes a combination hub which comprises:

a) a fixed base, b) a movable base which is displaceably mounted over the fixed base, c) the fixed base is supplied with a plurality of perforations which pass through the fixed base, d) which perforations lead to a key housing, e) the movable base is provided with a double number of perforations than those in the fixed base, each group of perforations matching the perforations of the movable base, f) the fixed base perforations houses through-pins of different heights, g) the movable base perforations include drive pins that are pressed by springs against the fixed base, and h) a flat-bit key has depressions which compensate for the bolt pins height so that, when the key is inserted, the whole of the internal ends of the fixed base bolt pins remain at the same level, thus enabling displacement of the movable base.

In such a combination hub, the fixed base perforations and the movable base perforations are cross and longitudinally aligned with respect to the rectangular bodies of the respective bases. The cross rows of the movable and fixed bases are equally spaced between them in such a manner so as to match when they overlap by the same number.

The movable base perforations groups are spaced apart by a distance greater than that which separates the cross rows between them, in a manner that allows extraction of the key when each group of perforations of the movable base matches the perforations of the fixed base, thus preventing key withdrawal in any other partial facing position.

Adjacent to the key housing outlet, the fixed base perforations have a smaller diameter area coinciding with the diameter of bolt pins and the inner end of the bolt pins has a greater diameter that coincides with the larger diameter of the fixed base perforations.

The double-action actuating mechanism comprises a control plate associated to the main latch, which plate is slidably mounted to allow for an alternating movement which matches the main latch. The plate is slidably biased by means of an elastic device that is fixed, on the one end, to the lock, and on the other end, to the control plate. A device limits the displacement of the control plate. A cam device is fixedly mounted on a through-axis and contributes with the stop device to release the stop device with respect to the control plate and, in turn, contributes to displace the control plate in a sense which is opposite to the tension of the elastic device.

The cam device consists of two equal cams that are operatively joined to knobs fixed to the ends of the through-axis cam. The cam surfaces cooperate with the limiting device and with the stop device provided in the control plate for the purpose of displacing the same against the elastic members.

A limiting device consists of "U" shaped member, whose arms are arranged laterally with respect to the control plate and which cooperates with the cam surface and juncture portion thereof in front of the rear edge of the control plate. The control plate has a recess that is able to match the juncture portion in a free position, and at the limiting position the rear edge with the juncture portion is normally forced to such limiting position.

A locking device of one of the cams corresponds to the external side of the lock, to lock the operation thereof with respect to the control plate. The control plate is fixed in the locking position by the combination hub that is provided in the lock.

The locking device consists of a lever with one end thereof coupled to a lock housing over the axis. The opposite end of the lever is disposed within the combination hub. The lever has, in its center portion, a locking surface that cooperates with a surface in the cam and is able to prevent rotation of the cam and is normally forced to this position.

A limiting device of the main bolt comprises a second latch device which is normally forced to a position out of the lock and which latches a control displacement of the main bolt holding device when both pass from their receded position inside the lock to their external position, in a manner that is able to allow the external displacement of the main bolt latch portion only.

A holding device comprises a plate which is mounted in a perpendicularly displaceable manner and is elastically forced with respect to the main bolt. The holding device comprises a displacement adjusting stop which is controlled by a cam surface provided for in the second latch device, which enables displacement of the plate against the main bolt, and a coupling device provided in the edge contacting the main bolt has a recess supplied in the same which, upon locking the same, allows for the partial travel of the main bolt such that the only portion remaining outside the lock is the latch device.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 6 shows a plan view A and an end view B of the key applicable to the combination hub of the lock according to the present invention;

FIG. 7 shows a front view of the supporting plate of the lock according to the present invention;

FIG. 8 is a sectional view taken from section A—A of FIG. 1;

FIG. 9 is a sectional view taken from Section B—B of FIG. 1;

FIG. 10 shows an end view of a combination hub, with partial cutaways in order to understand the operation thereof, and individual illustration of a bolt pin;

FIG. 11 is a perspective and sectional view of the fixed based and the movable base of the combination hub;

FIG. 12 is a plan view of the bottom surface of the movable base;

FIG. 13 is a plan view of the top surface of the fixed base;

FIG. 14 is a front view of the combination hub of another embodiment of the present invention and application thereof in order to control an elastic control system, in its inoperative position; and FIG. 15 is similar to FIG. 14 but in operative position.

DETAILED DESCRIPTION OF THE PRESENT INVENTION

Figure 1:
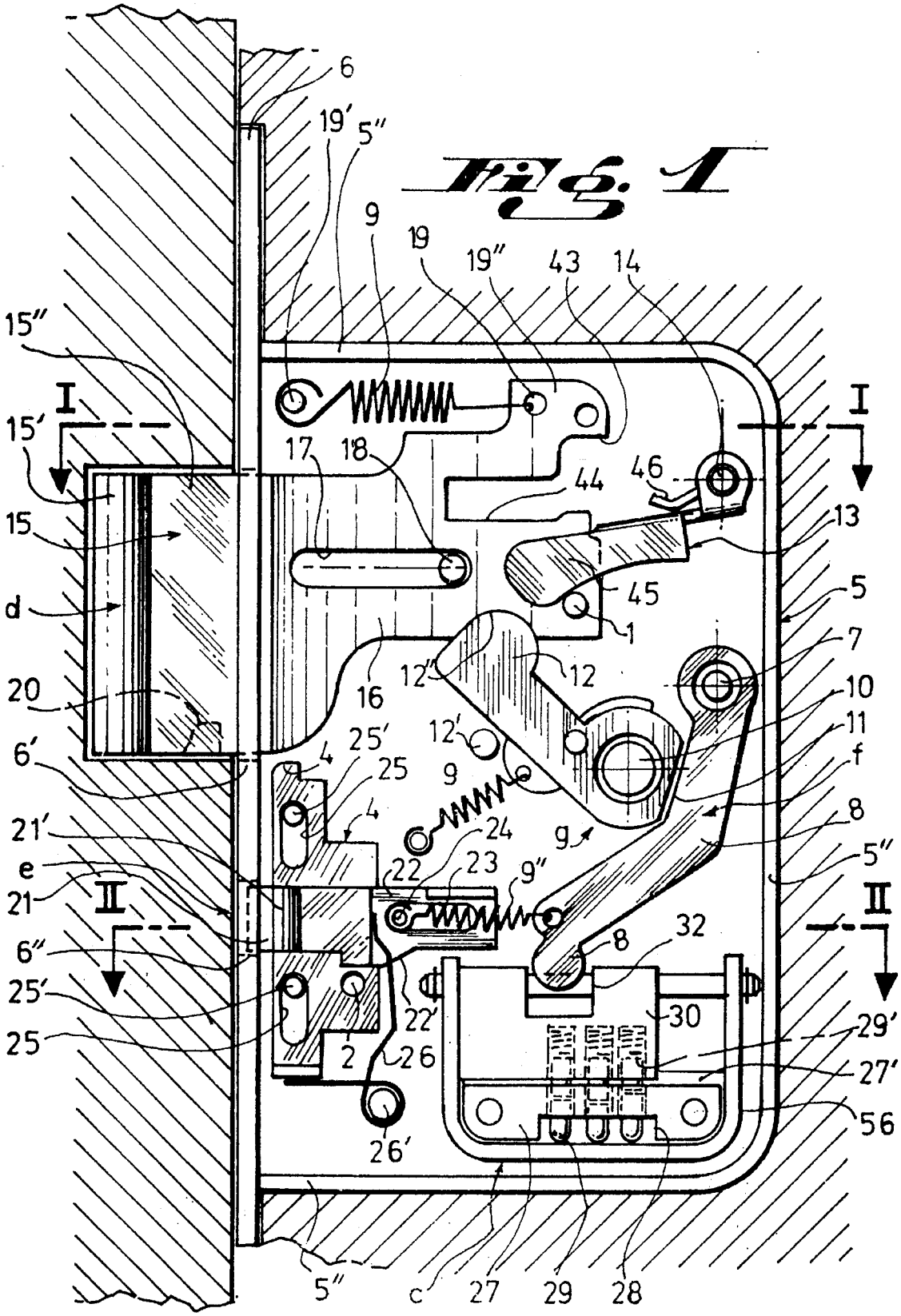
FIG. 1 illustrates an example of one embodiment of the lock according to the present invention, which shows the interior of the lock, without the external lateral wall, which lock is fitted to a door and frame in the closed position with the locking bolt extended within the frame housing and the combination hub also being in the closed position.

The lock according to the present invention comprises a housing 5, which shape is adapted according to the application thereof and whose shape in this practical example is designed to be used in a door. In the example shown in FIGS. 1 through 5, the shape of housing 5 of the lock is preferably rectangular, comprising two side walls 5', one internal and the other external, which along with the respective narrow lateral rear, top and bottom walls 5", define the thickness of the housing 5. A front part of the lock consists of a supporting plate 6 comprising an opening 6' for the passage of main bolt latch d and bottom opening 6" for a secondary bolt 21 smaller than main bolt d and which allows the same to operate as a latch or as locking bolt.

An axis 10 crosses through housing 5 in a rear central portion thereof. Axis 10 protrudes from both sides of housing 5 and is associated with control knobs b in order to rotate with the same. Knob 35' is the internal one and knob 35' is the external one.

Axis 10 is discontinued on its intermediate portion in order to form two halfshafts 10', which are separated by a partition in the way of armoring 37 which prevents access to the internal mechanisms should the half-axis, which bears knob 35, be disassembled from the outside.

As shown in FIGS. 1 through 4, main latch bolt d consists of a head 15, whose body is preferably rectangular and which external edge has a sloped plane which constitutes the latch portion 15'. Main latch bolt d continues in a body of parallel faces which form the locking bolt portion 15".

From the internal edge of locking bolt 15" a control plate 16 is fixedly coupled to bolt 15". Plate 16 is essentially flat and has a center portion that includes a slider 17 which houses a guiding pin 18 that is fixed to housing 6. Control plate 16 includes at its top portion, a protrusion 19" with a coupling device 19 in the form of a through bore, for the end of a spring 9. The other end of spring 9 is fixed at a pin 19', which is fixed to housing 5 adjacent to the supporting plate 6 and thus out of the housing. Spring 9 normally biases or forces main latch bolt d out of said supporting plate 6. Displacement of the latch bolt d is limited by guide pin 18, with slider 17.

A notch 44 is provided at the inner rear edge of control plate 16, which notch allows housing of a locking device 13. Locking device 13 has a horizontally set upside down "U" shape, with its arms 45 positioned at both sides of control plate 16. Through a joining link of the arms 45, locking device is framed onto an axis 14 disposed in housing 5. Locking device 13 is elastically forced, by means of a spring 46 assembled on axis 14, to rotate in a counterclockwise sense, as viewed in FIG. 1, which is limited by a pin 1. Pin 1 being fixed with respect to and passing through both sides of control plate 16 near its bottom edge. Arms 45 of locking device 13 rest on pin 1.

Further, at the bottom edge of locking bolt 15" portion of main latch bolt d there is a notch 20 which, upon a certain displacement position of said main latch bold d faces and allows for the retention of a locking tooth 4 formed on the upper edge of plate 4'; which, along with secondary bolt 21, constitutes a device e which enables main latch bolt d to function as a latch.

Plate 4', forming locking tooth 4, is provided with a pair of sliders 25 in the form of an elongated slot, which is arranged perpendicularly with respect to the alternating movement of main latch bolt d. A pair of guiding pins 25' are fixedly disposed in the housing 5 and rests on the bottom edge of plate 4'. Tooth 4 normally tends to insert itself into notch 20 when tooth 4 coincides with the notch and main latch bolts d retention or release device c is enabled.

Figure 3:
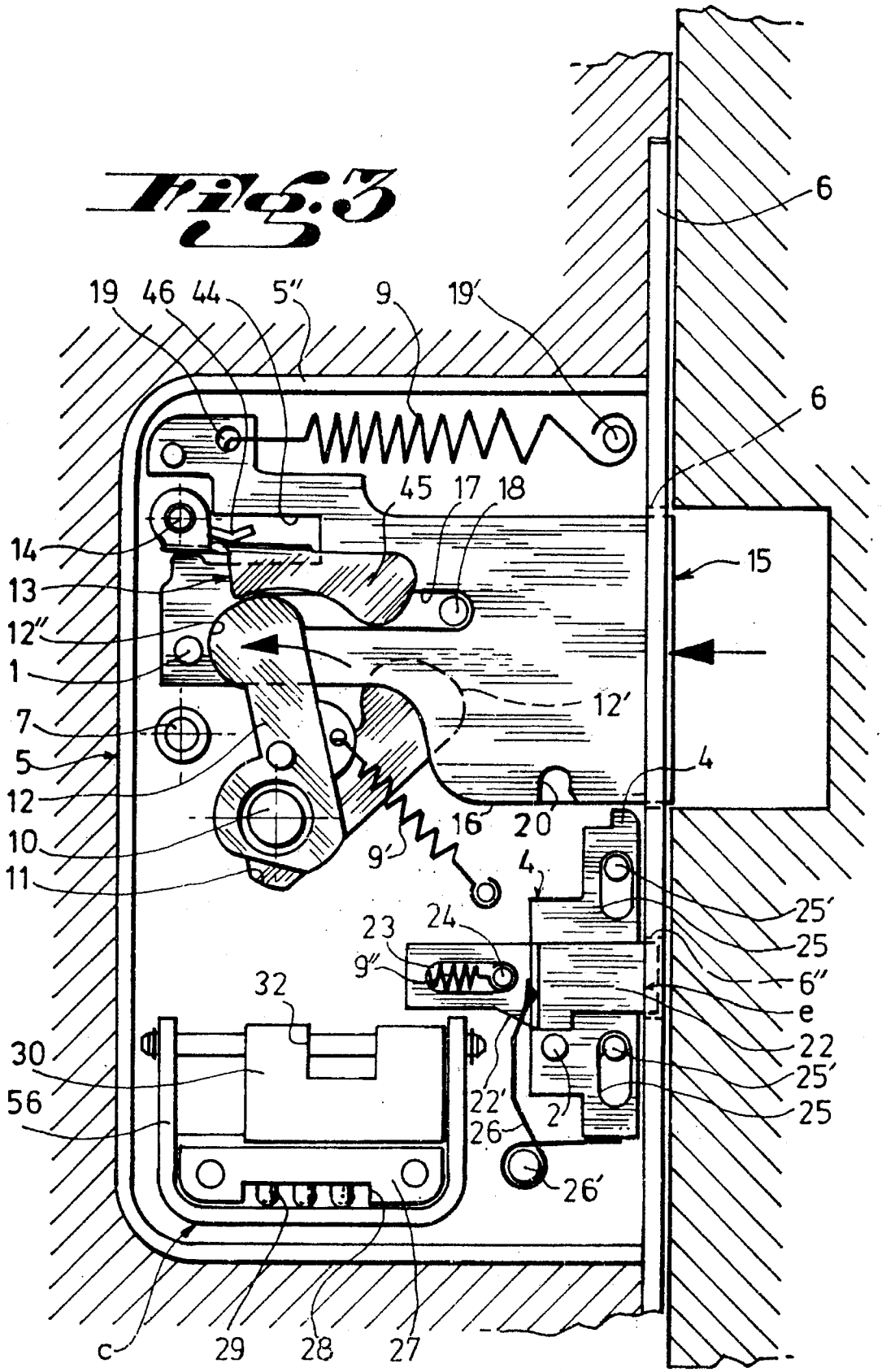
FIG. 3 is a view of the interior of the lock, without its inner lateral wall, fitted to a door and frame in its open position as from the interior with the combination hub in the closed position.
Figure 4:
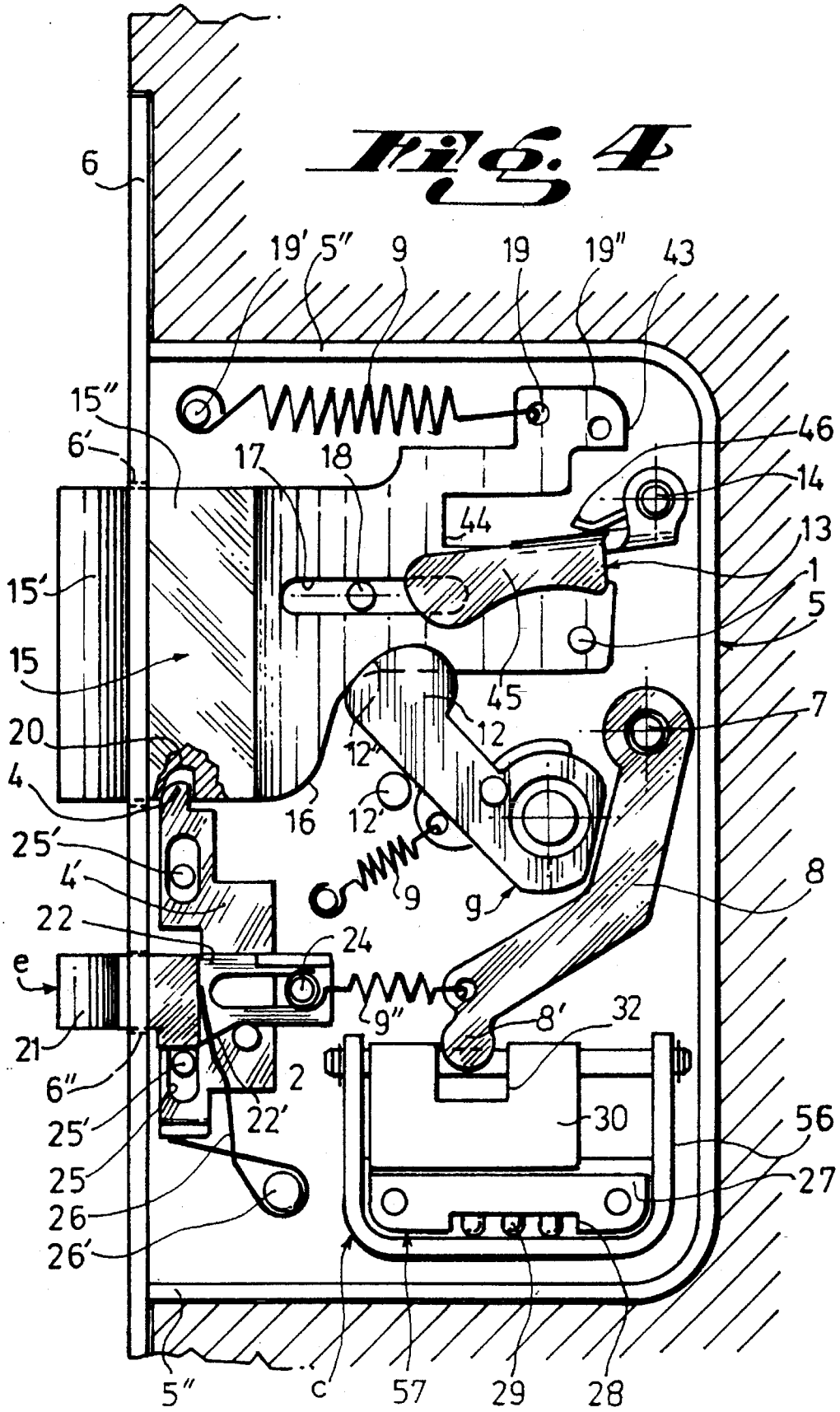
FIG. 4 is a view similar to FIG. 1, which shows the mechanism in its open position, outside the frame, and showing the position of the latch once opening has taken place from indoors without a key in the combination hub or from outside with the key.
Figure 5:
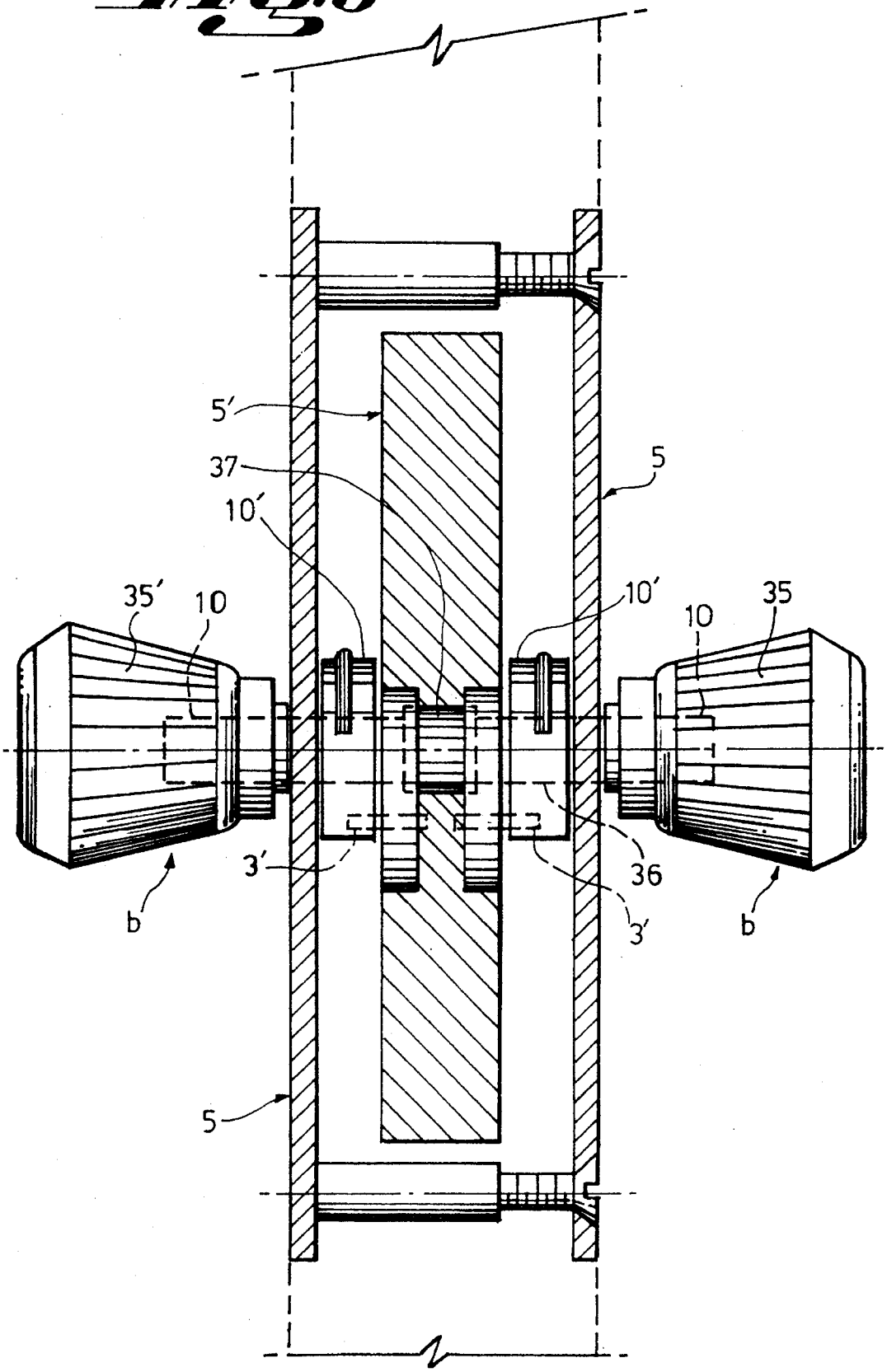
FIG. 5 is a schematic section of a lock (shown as a block) applied to a door.

As illustrated in FIGS. 1, 3 and 4, in housing 5, under main latch bolt d and laterally to plate 4', a secondary bolt 21, whose head 21' has a sloped plane in the way of a latch, protrudes through supporting plate 5 in an opening 6". Secondary bolt 21 does not have a housing counterpart at the door frame, whereby, when the door is closed, secondary bolt 21 remains inside housing 5.

Secondary bolt 21 has a substantially flat end 22 that is positioned inside housing 5 and is parallel to plate 4'. Flat end 22 has a slider 23 in the form of an elongated slot. A guiding pin 24 is fixed to the housing 5. Pin 24 operates as a guide for the alternating movement of secondary bolt 21.

The other leg of spring 26 rests on the inner surface of head 21' and presses or biases the secondary bolt 21 into the protruding position externally to supporting plate 6.

A bottom edge of flat end 22 has a sloped plate 22', which is associated with a protruding pin 2 that is fixed to adjoining plate 4'.

Under main latch bolt d and on the edge opposite to secondary bolt 21, a secondary lever f which at its bottom end, adjoining main bolt d, is jointed to a fulcrum 7 and extends onto a bottom portion of housing 5 between rear wall 5" and cam g of rotation axis 10 and terminates at power end or arm 8'. End 8' is inserted in notch 32 of a slide 30 which is member of a combination hub c. Power arm 8' is fixed to the end of a contraction spring 9" whose other end is fixed to pin 24 of housing 5.

On axis 10 and at each external side of housing 5, two washers 10', bearing pins 3' which join housing 3, are provided for on a couple of cams g arranged in a solidary free rotation manner with axis 10, inside housing 5.

Cam g, which is disposed on an external side of the door, has a flat face 11 which is parallel and cooperates with and forces a flat edge of lever f in such a way that lever f locks or prevents the rotation of the external cam g.

External cam g has a spring 9' which tensions or biases cam 8 to rotate in a counterclockwise manner. A stop 12' is fixedly disposed on housing 5 and limits the rotary displacement of external cam g. Cam 2 is complemented with an arm 12 which has a cam surface 12". An internal cam g is structurally equivalent to the external one, and includes spring 9' and stop 12'.

Figure 2:
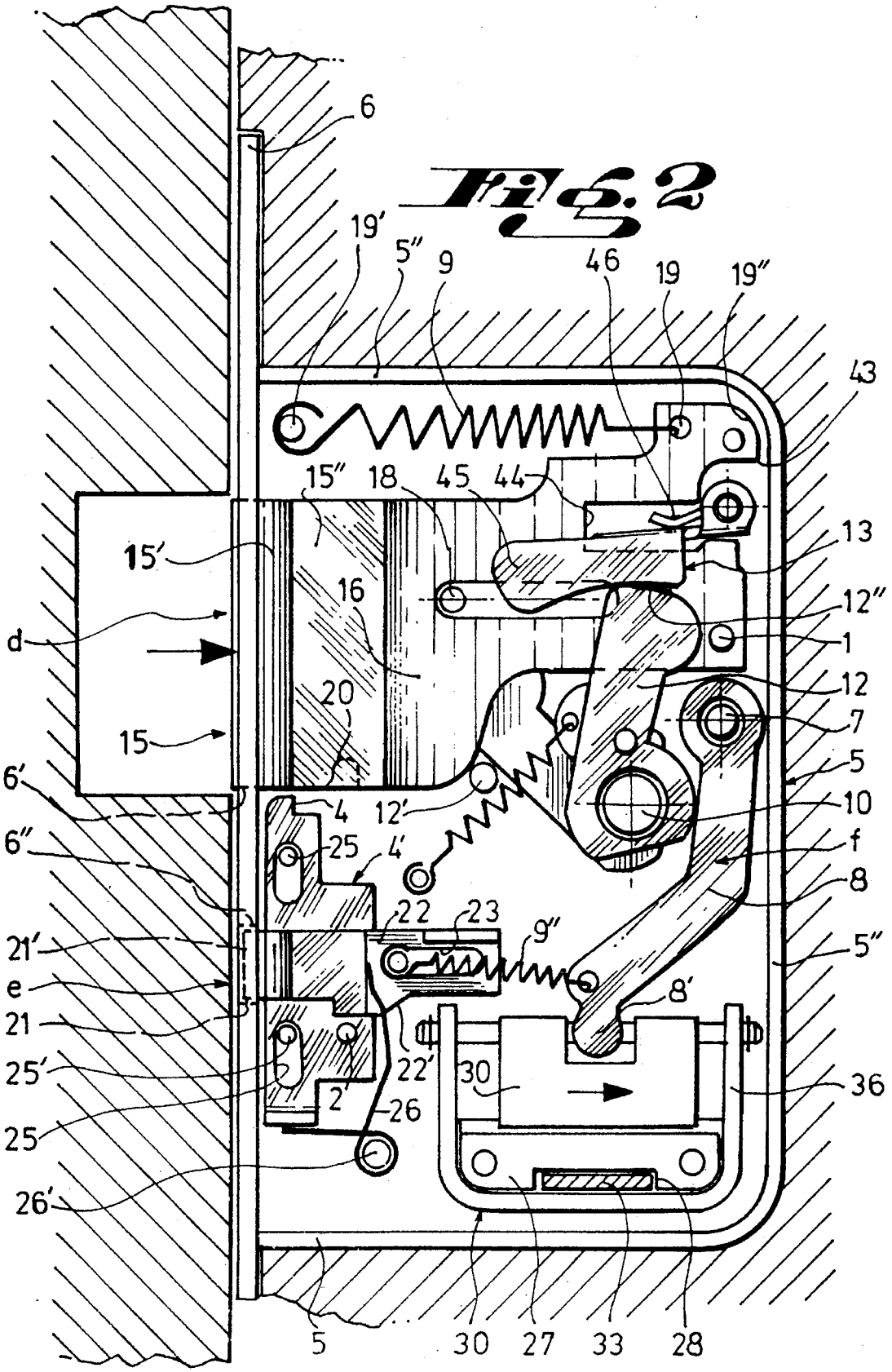
FIG. 2 is a view similar to that of FIG. 1, which shows the mechanism in its open position as from the outside with a key inserted in a combination hub and in the open position.

At the rear and bottom portions of control plate 16, pin 1 protrudes laterally and on both sides of plate 16. Pin 1 is arranged such that the travel of arm 12, when cams g rotate clockwise, abuts against pin 1 and displaces main latch bolt d against the biasing force of spring 9. The surfaces of cam 12" lift arms 45 against the biasing force of spring 46 to cause the joining bridge of lock 13 to be housed in notch 44, thus enabling displacement of main latch bolt d from its external position (FIG. 1) to its internal position (FIG. 2).

Combination hub c enables displacement of lever f in a counterclockwise direction upon operation of external knob 35 over external cam g, when the correct key 33 is inserted in a keyway 28. A fixed base 27, which body preferably has a rectangular shape, has an upper face that includes a protraction 27' in the form of guide rail. Fixed base 27 is provided in its bottom face with a transversal notch which constitutes the keyway 28 of combination hub c. In correspondence with the keyway 28 notch, there are a plurality of perforations 50, which in this particular embodiment amount to nine, which are arranged in rows of three perforations, and are aligned with respect to keyway 28 notch.

Perforations 50, at the area adjacent to the notch which forms keyway 28, have a smaller diameter portion 51 which defines step 52 internal to the larger diameter portion 53.

Perforations 50 house locking pins 29, which have a first narrow portion 54 of a diameter such that enables sliding thereof through the smaller diameter area 51. The end of locking pins 29 housed in the notch of keyway 28 having a semi-spherical shape, whereas the internal opposite end has a second enlarged portion 55 which displaceably fits in the larger diameter portion 53 and is able to stop against the internal step 52.

Fixed base 27 is mounted on a structure 56 of "U" shape over the horizontal plane. Each first portion 54 of bolt pins 29 has a different length. The assembly is completed by means of a slide 30 which has a rectangular body which is shorter than the fixed base 27 and which bottom face has a recess 57 which displaceable fits on protrusion 27'. Top face of slide 30 has a recess 58 on which a guide pin 31 is received. Guide pin 31 is fixed to both ends of the "U" shaped structure 56. A notch 32 is disposed in slide 30 for the control of lever f or any other control means for any system of bolts, latches or locking device of a lock or similar element.

Slide 30 is provided with a plurality of blind perforations or bores 60 in its bottom face that contacts fixed base 27. Perforations 60 coincide with perforations or bores 50 of the fixed base 27. The quantity of perforations on fixed base 27 coincides with the quantity of perforations on slide 30, such that when slide 31 is in its two extreme positions the perforation of the fixed base 27 coincide with the perforations of the slide 30.

Perforations 60 of slide 30 have the same diameter as portions of larger diameter 53 of perforations 50. Perforations 60 house drive pins 29' of the same or different length and which are pressed onto the fixed base 27 by a spring 61 that is housed between the bottom of blind perforation 60 and the end corresponding to drive pin 29'.

Thus, when perforations 60 of slide 30 face perforations 50 of fixed base 27, springs 61 drive pins 29' downwardly and pins 29' are partially inserted in perforations 50 of fixed base 27 and press on enlarged end 55 of bolt pins 29 such that the spherical ends of pins 29 occupy the notch of keyway 29 and contact against the base of structure 56.

The assembly is completed by a flat bit key 33 that preferably has a rectangular shape. An entering edge 33' of key 33 is bevelled sharp in order to facilitate entering thereof between the semi-spherical ends of bolt pins 29 and the base of structure 56.

Key 33 has spherical recesses or notches 34, which can be of different depth, and which appear as being of different diameter. Notches 34 are arranged in correspondence with perforations 50 of fixed base 27.

The depth of recesses or notches 34 is directly related to the length of drive pins 29 so that when key 33 is inserted in keyway 29, spherical ends of drive pins 29 are housed in recesses or notches 34 in such a way that the recesses or notches compensate for the different length of drive pins 29 so that the enlarged top end 55 is level with the top surface of fixed base 27 thus enabling slide 30 to slide upon the fixed base 27 upon the action of lever f on notch 32.

In the lock example illustrated by FIG. 1 through 4, where there is shown an automatic closing mechanism, by means of which the key is only used in order to open the lock from outdoors, combination hub c may be conformed by a same number of drive pins 29' of slide 30 with respect to bolt pins 29 of fixed base 27.

When the combination hub c is applied to safes, where it is essential that the key be only withdrawn in the "open" position and another "closed" position, it is necessary that slide 30 present a double quantity of drive pins 29' with respect to bolt pins 29 of fixed base 27. In addition, it is necessary that each group of perforations 50 of fixed base 27 and be separated by a gap larger than the separation between rows of perforations 60 as illustrated by FIGS. 14 and 15.

In this way, bolt pins 29 of fixed base 27 only face the group corresponding to drive pins 29' of slide 30 when in end positions of the travel of same, whereby it is assured that the key will only be withdrawn in the extreme positions of the slide 30 which will correspond to the "open" (off) and "closed" (on) positions. This combination hub variable can also be used in order to connect and disconnect alarms, electrical appliances, etc.

It is to be noted that utilization of springs 61 in perforations 60 in order to press drive pins 29' onto the fixed base 27 allows for the combination hub c to be used in any position regardless of the gravity force and also, that displacement of drive pins 29' is not affected by vibrations, dust, humidity, oily gases, etc.

Slide 30 may also be coupled through a notch 32 to lever f in an embodiment illustrated in FIGS. 14 and 15. A stop 42 which in one of the travel stops of slide 30 presses push-button 41 of a microswitch 40, while it releases the same when in the opposite position. Thus, the device per sé may constitute a closing or safety device for equipment, devices or diverse machinery, such as burglar alarms, vehicles driving access restrictions, computing systems, security environments, etc. The device is directly controlled by a key 33 of special combination given by notches 34 provided in the bit of the key in such a way that until this key 33 is not inserted, or when the same has a different combination 34 to that which actually corresponds, slide 30 will not slide with respect to base plate 27.

Constituted in such a way as previously described, the lock operates as follows:

As it has already been stated, should key 33 be not placed with the corresponding combination or recesses or notches 34, slide 30 will not slide over its fixed base 27 because bolt pins 29 of fixed base 27, aligned with drive pins 29' of slide 30 are displaced. Thus, any movement of slide 30 is prevented. Until a key 33, having a correct combination, is introduced in keyway 28, lever f remains immobilized by slide 30 itself. In turn, through fiat face 11, external cam g is immobilized which prevents retraction of main latch bolt d into housing 5, upon operation of cam 12 over pin 1 of control plate 16.

Thus, main latch bold d, in the position illustrated by FIG. 1, only actuates as a locking bolt, as bolt 15" portion is fully housed in the door frame cavity and, as a consequence thereof, the door remains closed with a safety lock and may only be opened from outdoors by means of the corresponding key, as will be explained hereinbelow.

Nevertheless, the door may be opened from the house interior, due to the fact that the internal knob 35' actuates internal cam g; which does not have the lock represented by lever f, as this is only disposed on the external cam g displacement. The internal cam g actuating against the operation of the spring 9', displaces the surface of cam 12", arm 45 of the locking device 13 into notch 44. Arm 12 abuts pin 1 of control plate 16 and displaces main latch bolt against the action of spring 9 to the position of full retraction into housing 5, whereby the door is opened. Secondary bolt 21 does not have a corresponding housing in the door frame and thus remains within housing 5 when the door is closed.

Should it be desired that the door be opened from outside, a key 33 must always be used. Key 33 is introduced in keyway 28, whereby recesses or notches 34 align top surfaces of enlarged portion 55 of drive plans 29 and slide 30 may then be freely displaced over fixed base 27. On the contrary, when displacement of slide 30 is released by introducing the corresponding key 33 (see FIG. 2), the end 8' of lever f is released, and upon operation (i.e., turning) of external knob 35, external cam g displaces lever f over its fulcrum 7 in a counterclockwise direction and rotates the external cam g over axis 10. A surface of cam 12" of cam arm 12, lifts "U" shaped lock 13 against the action of spring 46, in such a way that its joining brides no longer rests on internal lateral side edge 43 and faces notch 44. The advance of arm 12 continues until it abuts against pin 1 of control plate 16 and displaces main bolt 1 to the opening position leaving head 15 retracted inside housing 5 of lock.

Once the door is opened from the outside, and knob b releases cam g carried by spring 9', lever f, drawn by spring 9" and slide 30" pushed by end 8' of power arm 8, return to their respective initial positions (FIGS. 1 and 3). In such a position, bolt pins 29 recover their free motion and enable removal of key 33, which was temporarily retained in keyway 28 when slide 30 was displaced along with lever f.

Once the door is opened, be it if from the indoors without the key or from the outdoors by means of the key, it is necessary that main latch bolt d recover its function as an actual latch so that the door can be closed. That is, the main latch bolt d can not return to the position shown in FIG. 1, as the portion of bolt pin 15" would prevent an automatic closing of the door.

When the door opens and support plate 6 is no longer facing the frame, the secondary bolt 21, upon operation of spring 26 over internal edge of head 21' is enabled to displace itself out of housing 5 through opening 6". Pin 2 of plate 4' slides on sloped plane 22' on the bottom edge of the secondary bolt 21, thus allowing for the vertical displacement of plate 4' onto main latch bolt d. At this moment bolt d commences its outward displacement from housing 5 upon operation of spring 9. In this manner, lock tooth 4 rests on the bottom edge of the main latch bolt d and once it passes notch 20 thereof, is introduced into the notch 20. Thus, plate 4 retains main latch bolt d in an intermediate position, in which only the latch portion 15' remains outside housing 5, as shown in FIG. 4.

In this condition, when the door is closed, latch portion 15' and head 21' of secondary bolt 21, both via their sloped plane, in front of frame edge, are forced to slide into the housing 5, against springs 9 and 26, respectively. Upon displacement of secondary bolt 21 into housing 5, pin 2 of plate 4' slides on sloped plane 22', forcing plate 4' to move downwards with respect to main latch bolt d. Locking tooth 4 is thus released from notch 20, enabling full retraction of main lath bolt d within housing 5 until inner edge 43 of control plate 16 stops against the joining bridge of locking member 13, which rests on through-pin 1. The inner and outer cams g, upon operation of their respective springs 9', are displaced from their respective contacts with the arms 45 and pin 1, stopping against pin 12' that is fixed with respect to housing 5.

Upon facing of main latch bolt d to the corresponding cavity in the door frame, spring 9 displaces bolt d from it retracted internal position inside housing 5 and it is now housed in the door frame cavity. Thus, the automatic closing of the door with the safety locking bolt is enabled without the need of the additional use of a key, as is conventionally required with safety locks in order to displace locking bolts, be it from the outdoors or the indoors.

In order to effect the release and retention of combination hub c, as applied to security circuits as, for example, those destined to alarm operations, when key 33 is introduced into keyway 29, slide 30 is taken from the left to right positions via any control means (according to the illustrated example), and once it stops against the right limit, stop 42 presses pushbutton 41 of microswitch 40; whereby the apparatus is electrically connected (or disconnected, according to the type of circuit and the operation manner of microswitch). The alarm circuit or other applications are not illustrated as they are not relevant for the object of this invention, and due to the fact that they are obviously susceptible of infinite variations, according to each application and use.

Upon withdrawal of key 33, in such a position the apparatus remains connected without any possibility of disconnection; this fact renders it adequate for safety applications, such as alarms against car, burglary, safes, etc.

When disconnection of the same is required, all that is required is to insert the key once again and displace the slide to its initial position. Thus, a person who is not in possession of the key will not be able to connect the same once the key is withdrawn.

Finally, for an idea on the number of combinations which may be attained with the key 33 and drive pins 29 of the present invention, it is enough to consider the following:

For example, if we have 9 pins and 5 different heights for each of them, we have:

$5^9$=1,953,125 different combinations.

Upon a test carried out with a key 33 of 2½ millimeters thickness, six heights of drive pins were obtained: 0, 1, 2, 3, 4 and 5, and the result was: $6^9$=10,077,696 combinations.

With a key of three millimeters thickness, there can be obtained 0, 1, 2, 3, 4, 5 and 6, e.g., seven heights for the nine pins, which would render: $7^9$- 40,353,607 combinations.

And lastly, to the sole end of proving possibilities of this lock—even when it is not necessary—it is enough to assume keys of four rows of three drive pins 29 each, thus obtaining the operation of twelve pins without this meaning a distortion of key shape, and the result would be: $7^{12}$=13,841,287, 201 different combinations.

It is to be obviously understood that the above description is to be considered as exemplary of, but not specifically limiting the present invention, and therefore all modifications and variations in shape and constructions details that, though not illustrated, can be easily deduced from the present invention by a person skilled in the art are to be considered within the scope of the invention itself.

We claim

1. A lock comprising:

a housing having an indoor side and an outdoor side;

an axis passing through said housing from said indoor side to said outdoor side;

a main bolt having a bolt portion and a latch portion, said main bolt being displaceable into and out of said housing;

a double acting actuating mechanism coupled to said main bolt by said axis, said axis having a first pin to actuate said actuating mechanism and a second pin to actuate said actuating mechanism, said first pin and said second pin displacing said main bolt into and out of said housing;

locking means for preventing displacement of said main bolt;

a combination hub being disposed in said housing, said combination hub releasing said locking means when a combination key is introduced into said combination hub;

means for limiting the displacement of said main bolt upon movement out of said housing such that only said latch portion is exposed out of said housing, said combination hub comprises a fixed base and a movable base displaceably mounted on said fixed base, said fixed base being provided with a plurality of perforations which pass through said fixed base and which perforations end in a key housing, said fixed base being provided with a double group of perforations, each group of perforations coinciding with said movable base perforations, said fixed base perforations housing through-pins of different heights and said movable base perforations housing drive pins, said drive pins being pressed by springs against said fixed base, a flat bit key comprising depressions to compensate for the height of said bolt pins such that when said key is inserted in said key housing, an internal end of said each of bolt pins of said fixed base are at substantially the same level allowing for displacement of said movable base with respect to said fixed base.

2. The lock according to claim 1, wherein said perforations of said fixed base and said perforations of said movable base are perpendicular and longitudinally aligned with respect to a rectangular shape of said respective base.

3. The lock according to claim 1, wherein said perpendicular rows of said fixed and movable bases perforations are equally spaced so that said perforations overlap.

4. The lock according to claim 1, wherein said perforation groups of said movable base are spaced by a distance larger than that which separates said cross rows so as to allow for key withdrawal when each group of perforations corresponding to said movable base matches with perforations corresponding to said fixed base, thereby preventing withdrawal of said key in any other position.

5. The lock according to claim 1, wherein said fixed base perforations has a smaller diameter area, which coincides with the diameter of said bolt pins and the internal end of said bolt pins has a larger diameter portion which coincides with the diameter of said fixed base perforations.

6. The lock according to claim 1, wherein said locking means are disposed on an external side of said housing.

7. The lock according to claim 6, wherein said locking means comprises a lever coupled at one end to said housing and at an opposite end to said combination hub, said lever being provided in a central portion with a locking surface, said locking surface cooperates with a surface of a cam to prevent rotation of said cam, said lever being normally biased to a position corresponding to a cam rotation prevention position.

8. The lock according to claim 1, wherein said means for limiting displacement of said main bolt comprises a second latch means that is normally biased to a position exposed outside of said housing, said second latch means controls displacement of said main bolt when both pass from their retracted position inside said housing to their external position, in such a way to allow only said latch portion of said main bolt to be exposed out of said housing.

9. The lock according to claim 2, wherein said perpendicular rows of said fixed and movable bases perforations are equally spaced so that said perforations overlap.

10. The lock according to claim 2, wherein said perforation groups of said movable base are spaced by a distance larger than that which separates said cross rows so as to allow for key withdrawal when each group of perforations corresponding to said movable base matches with perforations corresponding to said fixed base, thereby preventing withdrawal of said key in any other position.

11. A lock comprising:

a housing having an indoor side and an outdoor side;

an axis passing through said housing from said indoor side to said outdoor side;

a main bolt having a bolt portion and a latch portion, said main bolt being displaceable into and out of said housing;

a double acting actuating mechanism coupled to said main bolt by said axis, said axis having a first pin to actuate said actuating mechanism and a second pin to actuate said actuating mechanism, said first pin and said second pin displacing said main bolt into and out of said housing;

locking means for preventing displacement of said main bolt;

a combination hub being disposed in said housing, said combination hub releasing said locking means when a combination key is introduced into said combination hub;

means for limiting the displacement of said main bolt upon movement out of said housing such that only said latch portion is exposed out of said housing, said double acting actuating mechanism comprises a control plate fixed to said main bolt, said control plate is slidably mounted, to attain an alternating movement in correspondence with said main bolt, by means of an elastic means that is fixed on the one end to said housing and on the other end to said control plate, means for limiting displacement of said control plate, means for elastically biasing said control plate and cam means fixedly mounted on said axis, said cam means cooperates with said limiting means to release said limiting means and simultaneously cooperates with said control plate to displace said control plate in a direction opposite to said elastically biasing means.

12. The lock according to claim 11, wherein said cam means includes a first cam that cooperates with said first pin to displace said control plate and a second that cam cooperates with said second pin to displace said control plate.

13. The lock according to claim 11, wherein said limiting means consist of a "U" shaped member having arms that are arranged laterally to said control plate and which cooperate with said cam surface and juncture portion of said arms thereof facing against a rear edge of said control plate which has a notch to receive said juncture portion when said limiting means is displaced by said cam surface.

14. The lock according to claim 12, wherein said limiting means consist of a "U" shaped member having arms that are arranged laterally to said control plate and which cooperate with said cam surface and juncture portion of said arms thereof facing against a rear edge of said control plate which has a notch to receive said juncture portion when said limiting means is displaced by said cam surface.

15. The lock according to claim 12, wherein said locking means are disposed on the external side of said housing.

16. The lock according to claim 15, wherein said locking means comprises a lever coupled at one end to said housing and at an opposite end to said combination hub, said lever being provided in a central portion with a locking surface, said locking surface cooperates with a surface of said cam to prevent rotation of said cam, said lever being normally biased to a position corresponding to a cam rotation prevention position.

17. A lock comprising:

a housing having an indoor side and an outdoor side;

an axis passing through said housing from said indoor side to said outdoor side;

a main bolt having a bolt portion and a latch portion, said main bolt being displaceable into and out of said housing;

a double acting actuating mechanism coupled to said main bolt by said axis, said axis having a first pin to actuate said actuating mechanism and a second pin to actuate said actuating mechanism, said first pin and said second pin displacing said main bolt into and out of said housing;

locking means for preventing displacement of said main bolt:

a combination hub being disposed in said housing, said combination hub releasing said locking means when a combination key is introduced into said combination hub;

means for limiting the displacement of said main bolt upon movement out of said housing such that only said latch portion is exposed out of said housing, wherein said means for limiting displacement of said main bolt comprises a second latch means that is normally biased to a position exposed outside of said housing, said second latch means controls displacement of said main bolt when both pass from their retracted position inside said housing to their external position, in such a way to allow only said latch portion of said main bolt to be exposed out of said housing, said means for limiting displacement of said main bolt comprises a plate which is mounted in a perpendicularly displaceable manner with respect to the direction of displacement of said main bolt, and is elastically forced into contact with said main bolt, said plate having a displacement adjusting stop that is controlled by a cam surface of said second latch means to enable displacement of said plate against said main bolt and a coupling means provided on the edge of said plate contacting said main bolt and which cooperates with a notch in said main bolt to permit the partial displacement of said main bolt such that only the latch portion is exposed out of the housing.

* * * * *

UNITED STATES PATENT AND TRADEMARK OFFICE

CERTIFICATE OF CORRECTION

PATENT NO. : 5,469,723

DATED : November 28, 1995

INVENTOR(S) : Noel LITVIN and Abraham I. SCHERZ

It is certified that error appears in the above-indentified patent and that said Letters Patent is hereby corrected as shown below:

Title page, [76], Inventors:, change "Litwin" to --Litvin--.

Item [19] should read —Litvin—.

Signed and Sealed this

Twentieth Day of February, 1996

Bruce Lehman

*Attest:*

BRUCE LEHMAN

*Attesting Officer*

*Commissioner of Patents and Trademarks*